US006299422B1

(12) United States Patent
Woodhouse

(10) Patent No.: US 6,299,422 B1
(45) Date of Patent: Oct. 9, 2001

(54) FLUID PUMP WITH A FLEXIBLE TOOTHED BELT

(75) Inventor: Timothy Charles Woodhouse, Milton Keynes (GB)

(73) Assignee: Stephen R. Tickner, Studham (GB); part interest ( * ) Notice: Subject to any disclaimer, the term of this patent is extended or adjusted under 35 U.S.C. 154(b) by 0 days.

(21) Appl. No.: 09/341,306

(22) PCT Filed: Jan. 5, 1998

(86) PCT No.: PCT/GB98/00007

§ 371 Date: Nov. 26, 1999

§ 102(e) Date: Nov. 26, 1999

(87) PCT Pub. No.: WO98/30801

PCT Pub. Date: Jul. 16, 1998

(30) Foreign Application Priority Data

Jan. 8, 1997 (GB) ..... 9700277
Dec. 16, 1997 (GB) ..... 9726507

(51) Int. Cl.[7] ..... F04C 5/00
(52) U.S. Cl. ..... 418/4; 418/153
(58) Field of Search ..... 418/4, 153, 156

(56) References Cited

U.S. PATENT DOCUMENTS 2,745,355 5/1956 Mosbacher ..... 418/4

FOREIGN PATENT DOCUMENTS 9109130 11/1991 (DE) .
4218148 10/1992 (DE) .
4414319 9/1994 (DE) .
19510079 9/1996 (DE) .
1221014 5/1960 (FR) .
55 57601 4/1980 (JP) .
1612112 * 12/1990 (RU) ..... 418/4

* cited by examiner

*Primary Examiner*—John J. Vrablik
(74) *Attorney, Agent, or Firm*—Dykema Gossett PLLC

(57) ABSTRACT

A fluid pump includes a fluid-tight housing containing two spaced, externally-toothed pulley wheels, an internally-toothed drive belt that wraps around and engages the teeth of the two pulley wheels and moves as they rotate, and a guide block in the space between the two pulley wheels. The housing includes a fluid outlet port adjacent where the drive belt engages a first of the two pulley wheels to discharge fluid pressed out from between the teeth of the drive belt, and a fluid inlet port adjacent where the drive belt disengages from the first pulley wheel. The guide block defines a first face that extends with the drive belt to a nip where the drive belt engages the first pulley wheel and a second face that includes a first portion which extends from the first face in an arc around the periphery of the first pulley wheel and a second portion which extends away from the periphery.

12 Claims, 6 Drawing Sheets

FLUID PUMP WITH A FLEXIBLE TOOTHED BELT

BACKGROUND AND SUMMARY OF THE INVENTION

This invention relates to a fluid pump, and is particularly, although not exclusively, useful for the self-priming pumping of liquids.

Gear pumps are known which entrain fluid into the mesh of two counter-rotating cogs and expel the fluid under pressure, but such gear pumps need fast rotation of the gears and require to be manufactured with close tolerances.

The present invention overcomes or mitigates these drawbacks of the gear pump. The present invention provides a fluid pump comprising an internally-toothed drive belt drivingly coupled to a correspondingly externally-toothed first pulley wheel and arranged over a belt guide, which preferably takes the form of a second pulley wheel, spaced from the perimeter of the first pulley wheel, a fluid-tight housing containing the drive belt and pulley wheel, and means for coupling the motion of the first pulley wheel and the drive belt to that of an external drive; the housing having a fluid inlet port communicating with a space between the pulley wheels and the belt guide, and a fluid outlet port closely adjacent the region at which the drive belt engages tangentially with the first pulley wheel with their respective teeth in partial engagement; whereby motion of the first pulley wheel causes fluid from the space between the pulley wheel and the belt guide to be drawn into the nip of the first pulley wheel and the drive belt and then to be expelled under pressure to the fluid outlet port.

The invention also provides,a pumping system comprising a main fluid pump and a pump according to the invention used as a primer for the main fluid pump.

The fluid pump of the invention has been found surprisingly to pump with great efficiency even at low rotational speeds; whilst the gap between the drive belt and the housing is important, there is still a reasonable degree of manufacturing tolerance allowed, and the fluid pump can be mass produced from plastics materials with great economy.

In order that the invention may be better understood, preferred embodiments thereof will now be described, by way of example only, with reference to the accompanying drawings.

DETAILED DESCRIPTION OF THE PREFERRED EMBODIMENTS

With reference to FIGS. 1 to 5 of the accompanying drawings, a first embodiment of the invention consists of a fluid pump 10 for pumping either air or another gas, or else a liquid such as a hydrocarbon or an aqueous liquid. The fluid pump may be used in an extremely wide range of applications, including for example as a fuel injection pump and as a primer for a larger pump. It is self-priming.

In this example, the fluid pump 10 has a box-shaped housing 20 with a front plate 23 removably secured thereto by screws (not shown). The space within the housing 20 is sealed from the exterior throughout by double track seals, and one example of this is shown between the housing 20 and the front plate 23, in the form of an O-ring 19.

Figure 1:
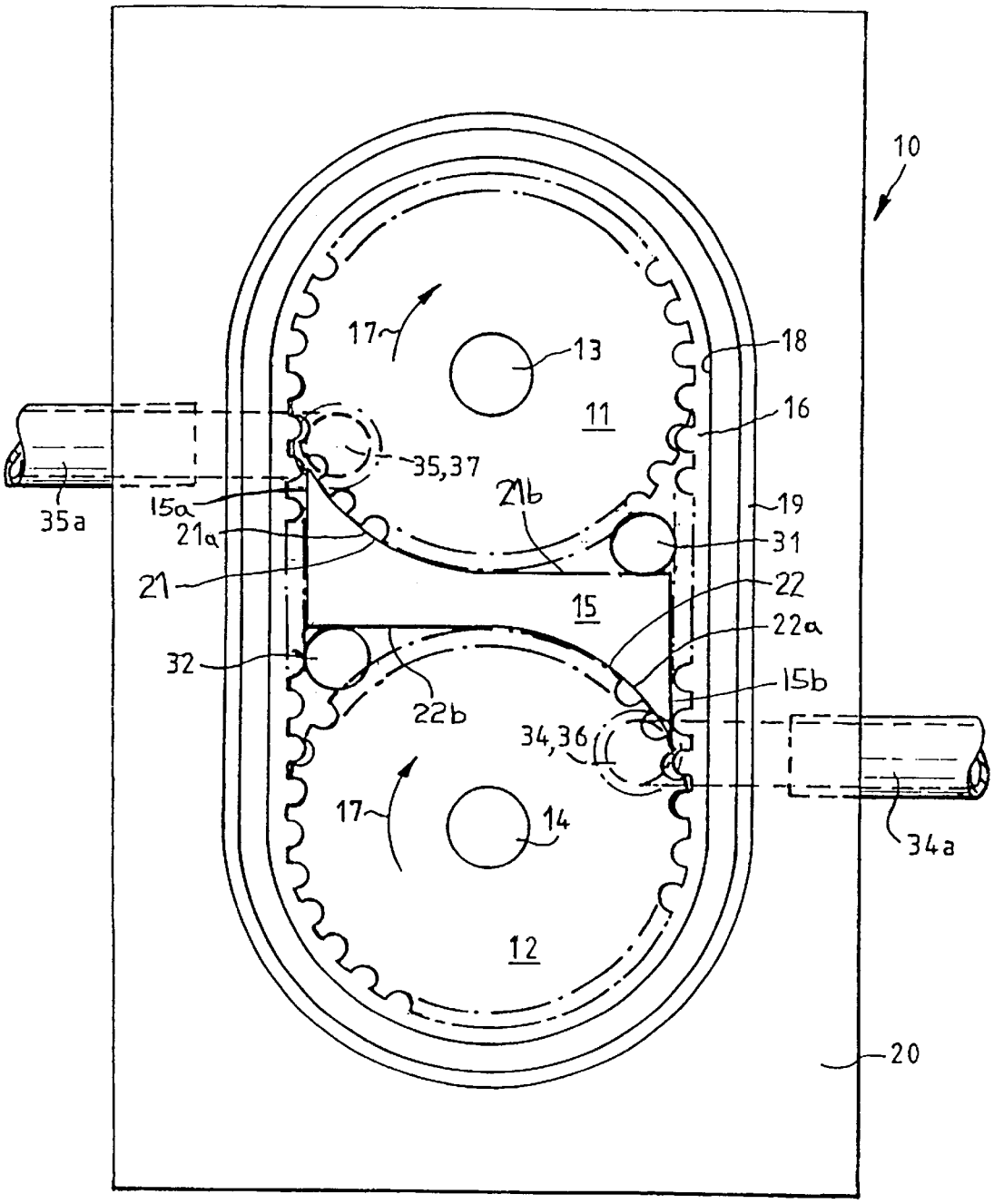
FIG. 1 is a front elevation of a first embodiment of the invention, but with a front closure plate removed for greater clarity.

The housing contains two identical spaced toothed pulley wheels 11, 12 mounted for rotation in a common plane on pins 13, 14 respectively. The pulley wheels mesh with an internally-toothed flexible drive belt 16, and rotate in the same direction 17. At least half of the space between the pulley wheels 11, 12 is taken up by a fluid guide block 15 which is as wide as the drive belt 16. As shown in FIG. 1, the guide block 15 has first faces 15*a*, 15*b* which define the lengthways path of the drive belt 16 between the pulley wheels. Second faces 21, 22 include arcuate first portions 21*a*, 22*a* which follow closely the path of the teeth of the respective pulley wheels into the nip between the drive belt 16 and each respective pulley wheel 11, 12. The first portions join the first faces 15*a*, 15*b*. Second portions 21*b*, 22*b*, which are shown as being flat, extend from the first portions away from the peripheries of the pulley wheels 11, 12.

The space between the pulley wheels 11, 12 communicates with a fluid source (not shown), i.e. with the pump inlet, by symmetrically-arranged fluid inlet ports 31, 32 and inlet pipes 31*a*, 32*a* connected respectively thereto. In this example, the inlet ports 31, 32 are on the rear of the fluid pump only, but another pair of fluid inlet ports could of course be arranged opposite those fluid ports, at the front side of the fluid pump.

As indicated above, fluid in the space between the pulley wheels 11, 12 is entrained by the teeth of the pulley wheels, and guided by the guide block 15, to enter the region at which the pulley wheel teeth mesh with the drive belt 16. The fluid is compressed by the meshing action of the teeth, as the internal teeth of the drive belt enter into the correspondingly-recessed portions between teeth of the pulley wheels 11, 12. In this example, the teeth are of a constant cross section across the width of the belt. In this particular example, in fact, the drive belt has an HTD profile, and has an 8 mm pitch with a 30 mm width: the pulleys are also of the HTD standard. However, any configuration of belt and pulley wheel which allows intermeshing with an associated fluid expulsion would suffice and could be substituted as appropriate to different engineering requirements.

One of the toothed pulley wheels could be replaced by a non-toothed one, or even simply by a stationary belt guide sufficient to keep the belt on its path around the first pulley wheel within the sealed housing.

I have discovered that the fluid is pumped by the intermeshing teeth, and that the gap between the housing and the belt and pulley, at least in the intermeshing region, is such as to cause the fluid to be expelled transversely, i.e. normal to the plane of the pulley wheels and drive belt. For this reason, outlet ports are disposed in two pairs, over the respective regions at which the drive belt engages tangentially with the first and second pulley wheels with their respective teeth in partial engagement. In this example, the two pairs of outlet ports are all cylindrical. A first pair 35, 37 is arranged adjacent the upper pulley wheel 11, with one outlet port 35 at the rear and the other outlet port 37 at the front, facing in mutually opposite directions. At the corresponding position over the second pulley wheel 12, outlet ports 34 and 36 are also disposed on opposite sides of the pulley wheel. In each case, the diameter of the outlet port is approximately 1.5 times the spacing between adjacent teeth of the pulley wheel 11. However, the outlet ports do not have to be cylindrical, and they could for example be slot-shaped or arcuate. Their overall length, following the path of the pulley wheel teeth, is preferably in the range of 1 to 4 times the spacing of the teeth, and advantageously even between 2 and 4 times the spacing, the greater length tending to reduce the back pressure and hence the unwanted hydraulic braking.

Figure 2:
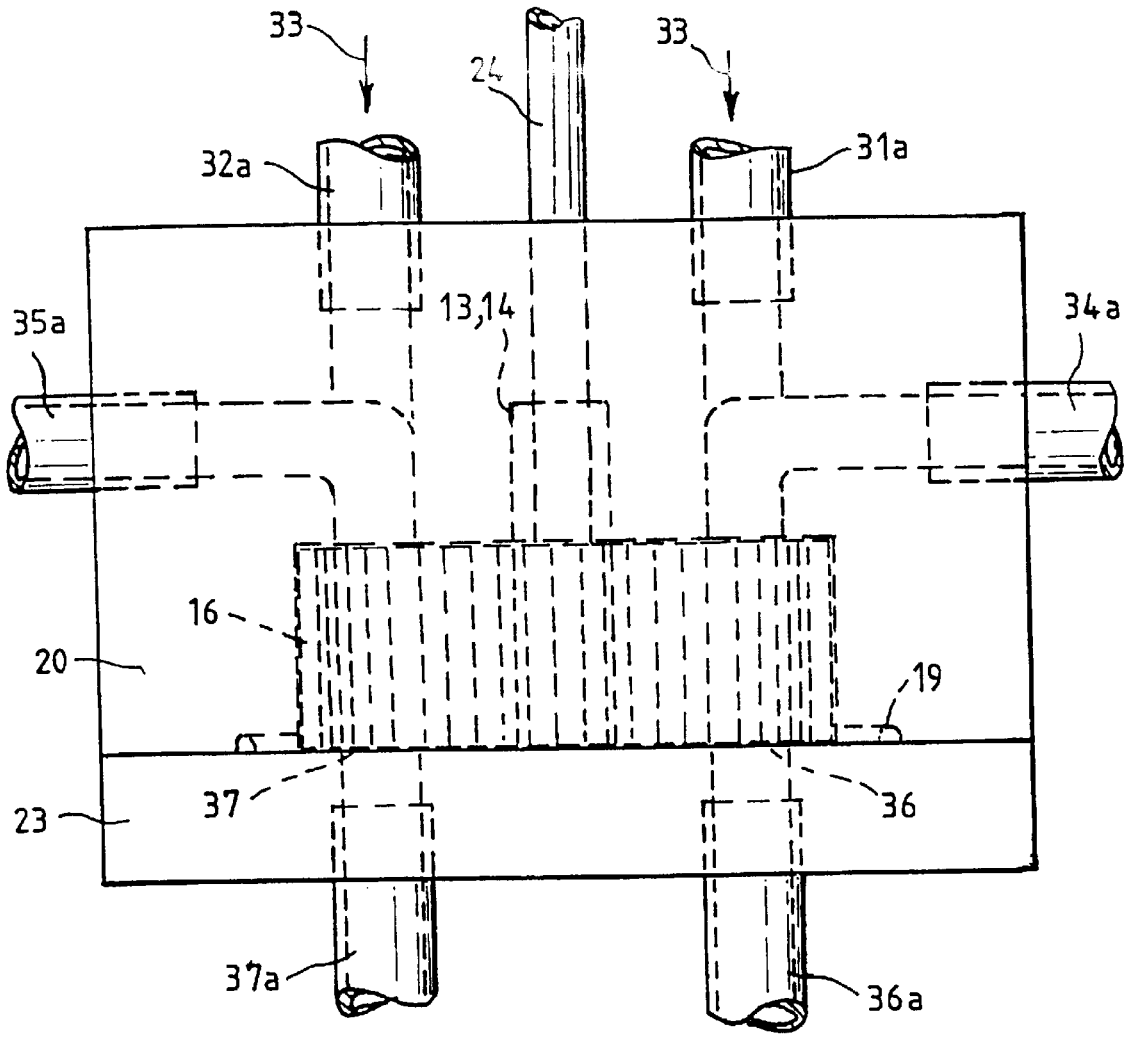
FIG. 2 is a top plan of the fluid pump of FIG. 1, including the front closure plate.
Figure 3:
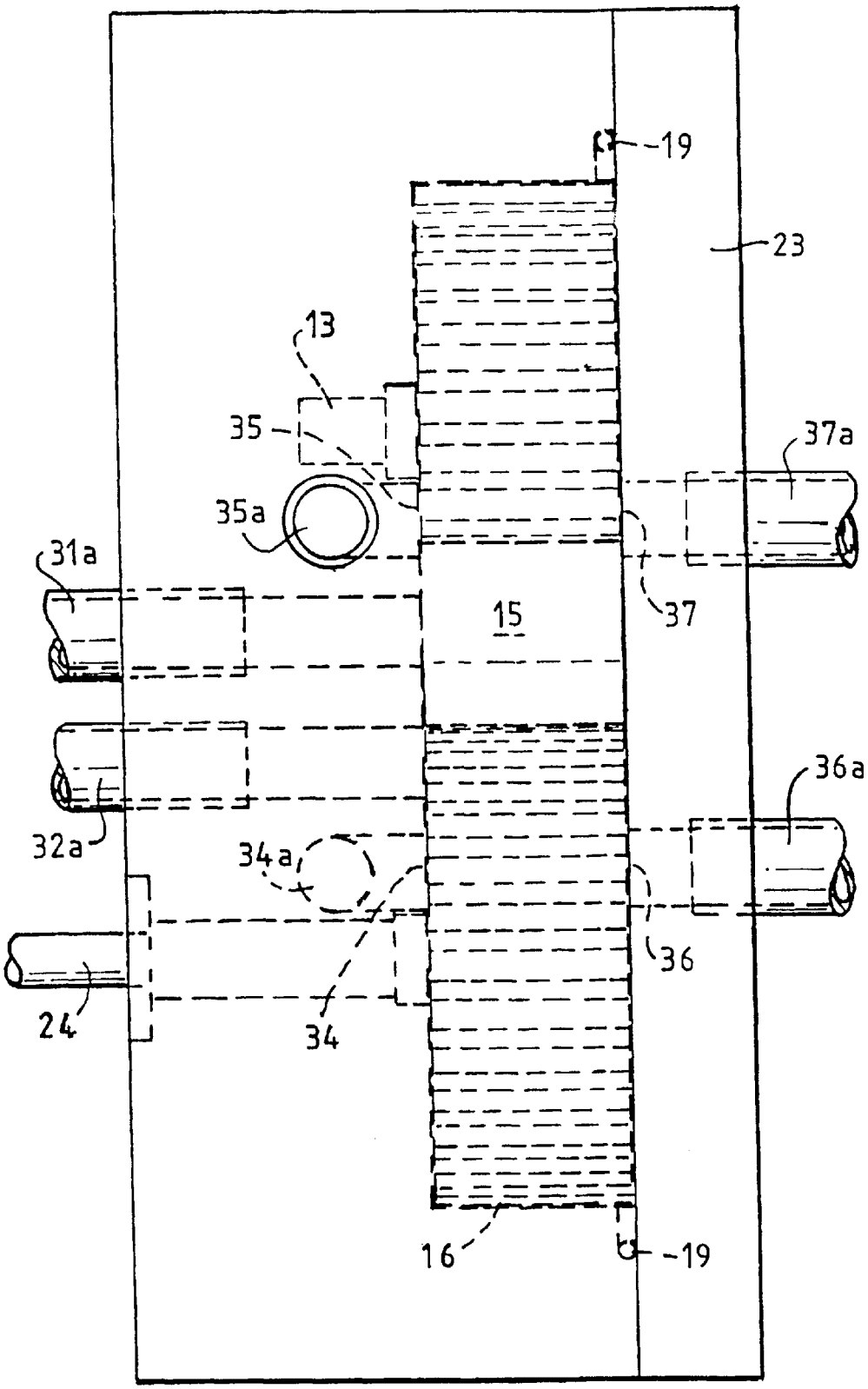
FIG. 3 and FIG. 4 are respectively left-hand and right-hand elevations of the fluid pump of FIGS. 1 and 2.
Figure 4:
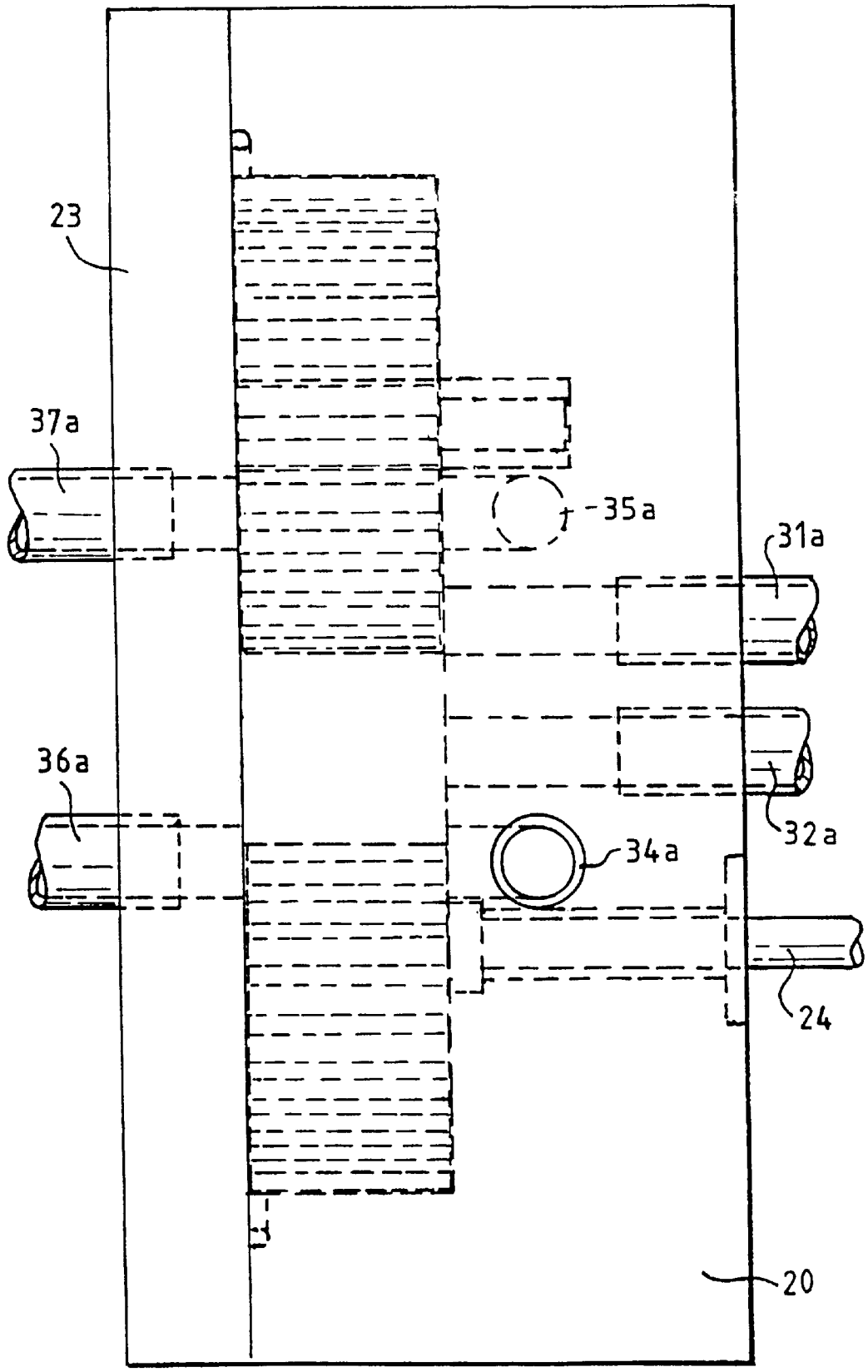
Figure 5:
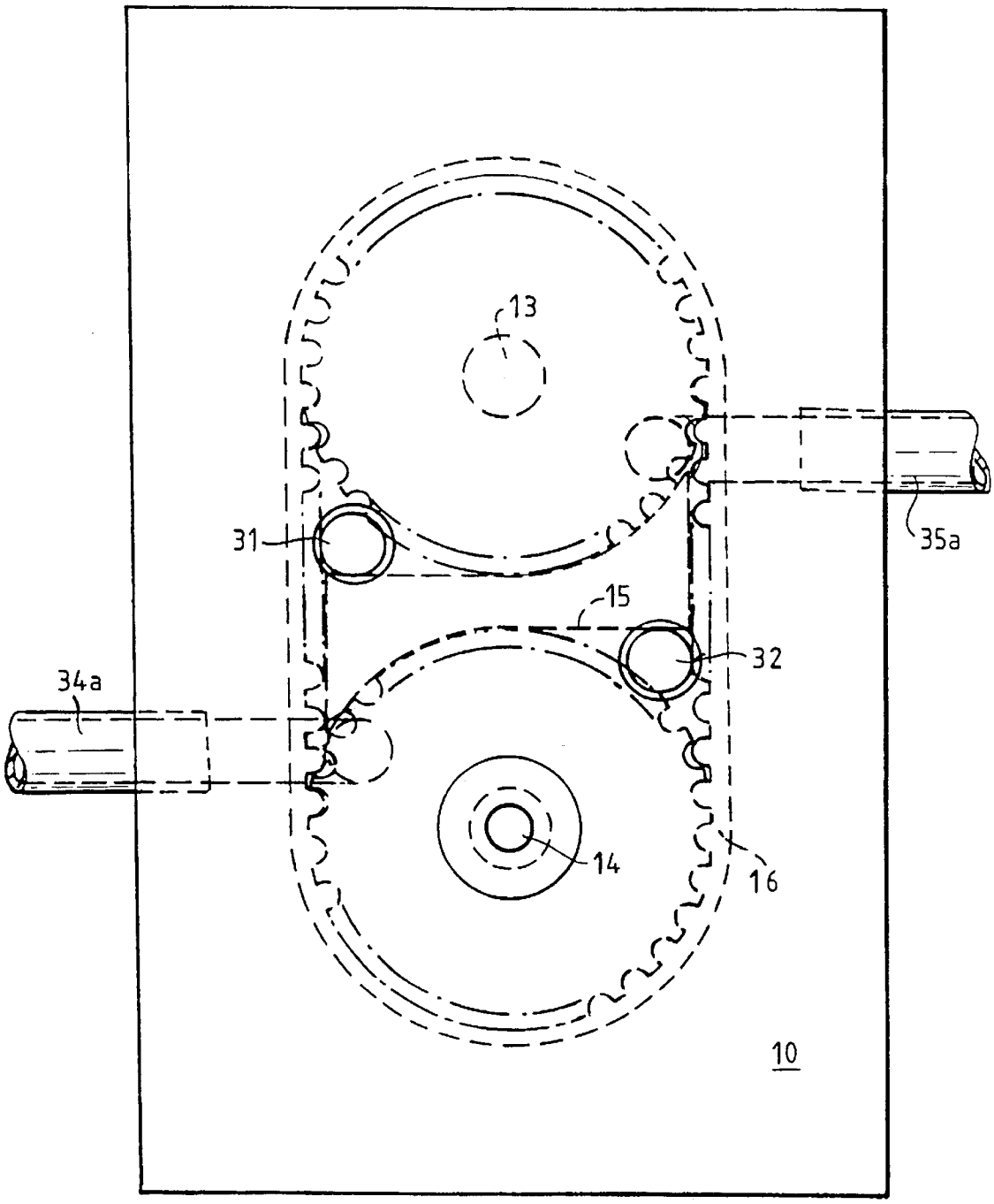
FIG. 5 is a rear elevation of the fluid pump of FIGS. 1–4.

In this example, the outlet ports at the rear communicate with bores in the housing 20 which exit the housing on its left and right-hand sides, as shown most clearly in FIG. 2. The outlet ports 34–37 communicate respectively with outlet pipes 34*a*–37*a*.

The pulley wheels, 11, 12 are driven by an external prime mover (not shown) such as an electric motor through appropriate gearing. In this example, the prime mover is drivingly coupled to the lower pulley 12 through a spindle 24 on the axis of the pulley.

The gap between the outer smooth surface 18 of the drive belt 16 and the inner surface of the housing is fairly constant and is sufficiently narrow to restrict fluid flow, yet sufficiently wide to allow relative movement. Preferably the gap is in the range of 0.1–2 mm. The gap is particularly important in the region of the outlet ports.

In the alternative examples where there is only one toothed pulley wheel, clearly there would only be one nip region to use as the pump fluid outlet.

Clearly the efficiency of the pump, the velocity ratios and mechanical advantages and other relevant parameters will be selected by appropriate design, to suit the pumping requirement. For the pumping of fluids, I have found that it is advantageous to set the width of the drive belt in the range of 0.1–0.5 times the radius of the pulley wheel. For greatest efficiency, I have found it ideal to have the two pulley wheels equal in size, but this is not essential, and neither is it essential for the second pulley wheel to be toothed, if the second pair of outlets is not required. Further, while two pulleys are provided in this example, a different number could function satisfactorily.

In the preferred example, the belt is of polyurethane, although other plastics materials are envisaged. It is of course important that the drive belt should be of an impervious material, when liquids are to be pumped. Again, in this example, the pulley wheels are of nylon (registered trade mark) or other thermoplastics compounds, and the pins 13, 14 are of stainless steel, the housing 20 being of aluminium and the front plate 23 of perspex, but for mass production it is envisaged that an all-plastics assembly would be appropriate and would offer greatest economy. Different plastics materials may be used for different components.

The pump illustrated in FIGS. 1 to 5 has been driven at 150 rpm, and at this speed it developed a pressure differential of 0.8 bar, pumping water at 7.5 litres per minute, with an internal pressure of greater than about 20 bar (300 psi). To achieve this pumping action, the pump was driven by a 380 watt electric motor.

Figure 6:
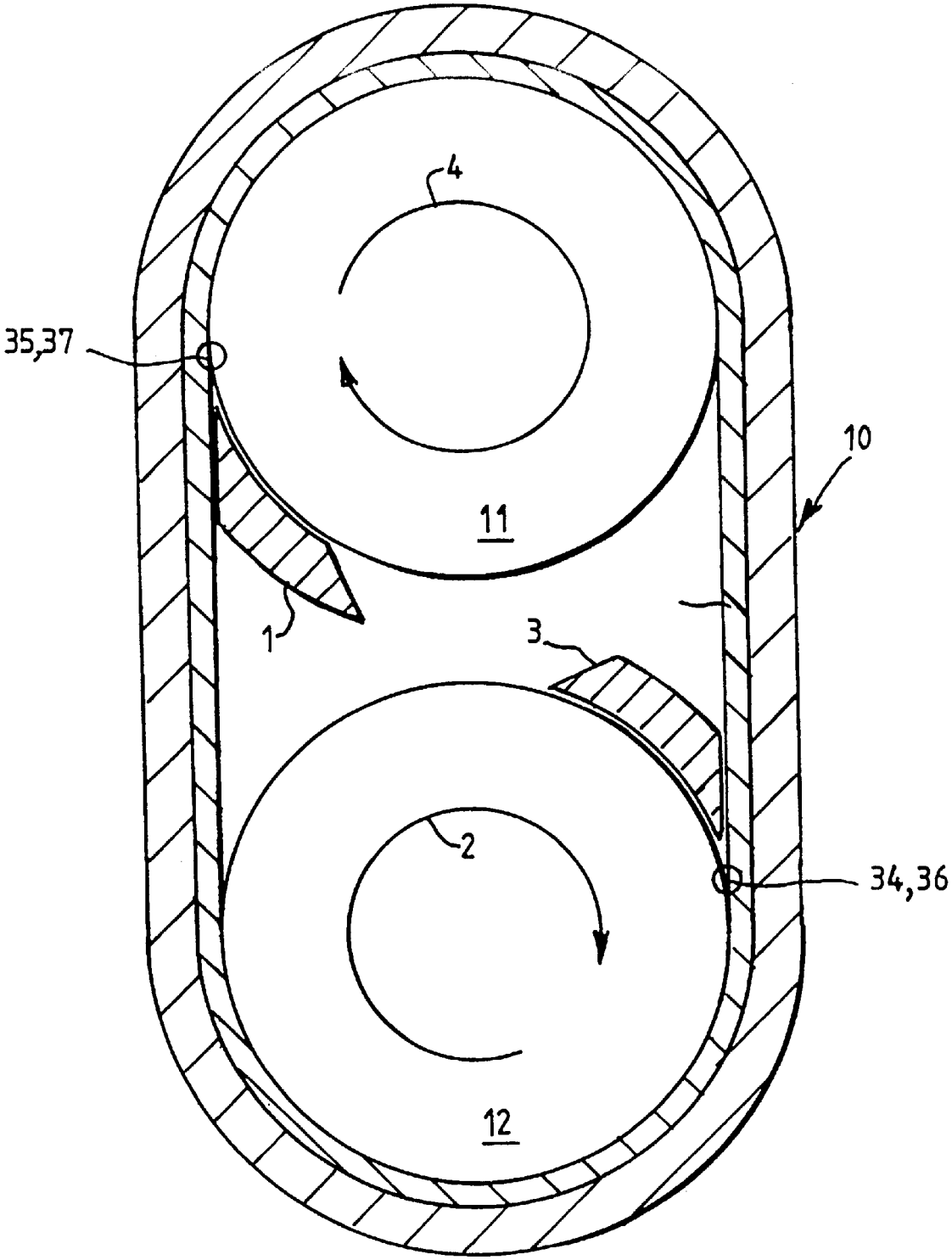
FIG. 6 is a front elevation of a modification, as a second embodiment of the invention.

A second embodiment of the invention will now be described with reference to FIG. 6, which shows a variant of the first embodiment in a view corresponding to FIG. 1.

Instead of the guide block 15, there are two guide blocks 1,3 following part of the periphery respectively of pulley wheels 11 and 12 which are driven in the directions 4 and 2. This leaves more open space in the region between the pulley wheels.

What is claimed is:

1. A fluid pump comprising an externally-toothed first pulley wheel; a second pulley wheel spaced from a periphery of the first pulley wheel; an endless internally-toothed drive belt drivingly coupled to and wrapped around the externally-toothed first pulley wheel and the second pulley wheel; a fluid-tight housing containing the drive belt and the first and second pulley wheels; means for coupling the motion of the first and second pulley wheels and the drive belt to that of an external drive; a fluid inlet port in the housing communicating with a space between the first pulley wheel and the second pulley wheel; a fluid outlet port closely adjacent a region where the drive belt engages tangentially with the first pulley wheel with their respective teeth in partial engagement; and a guide block located within the space between the first pulley wheel and the second pulley wheel, the guide block having a first face adjacent a portion of the belt which in use approaches the fluid outlet port, and a second face adjacent the portion of the first pulley wheel which in use, approaches the fluid outlet port, wherein the first and second faces of the guide block meet at a point which is closer to a location where the drive belt comes into mesh with the first pulley wheel than the distance between a location where the belt comes out of mesh with the first pulley wheel and the nearest portion of the second face of the guide block, said second face of the guide block including a first portion which extends from the first face in an arc around the periphery of the first pulley wheel, and a second portion which extends from the first portion away from said periphery, whereby motion of the first pulley wheel causes fluid from the space between the first pulley wheel, the second pulley wheel, and the guide block to be drawn into a nip between the first pully wheel and the drive belt and then to be expelled under pressure to the fluid outlet port.

2. A fluid pump according to claim 1, wherein the drive belt has a width in the range of 0.1–0.5 times the radius of the first pulley wheel.

3. A fluid pump according to claim 1, wherein the drive belt is of a plastics material and/or the housing and pulley wheels are of a plastics material or of respective different plastics materials.

4. A fluid pump according to claim 1, wherein said second portion of said guide block is flat.

5. A fluid pump according to claim 1, wherein the housing and drive belt have therebetween, for at least a portion of the belt path around the nip of the first pulley wheel and the drive belt, a narrow gap sufficiently wide to allow relative movement but sufficiently narrow to restrict fluid flow, and the fluid outlet port, where it communicates with the space between the first pulley wheel and the drive belt lies wholly within the area defined by the outer surface of the drive belt.

6. A fluid pump according to claim 5, wherein the said narrow gap is in the range of 0.1–2.0 mm.

7. A fluid pump according to claim 1, wherein the fluid outlet port faces one side of the first pulley wheel so that it receives fluid expelled transversely thereof, generally normal to the plane of rotation of the drive belt and pulley wheels.

8. A fluid pump according to claim 7, wherein a further fluid outlet port is located transversely opposite the said fluid outlet port so that it receives fluid expelled transversely in the opposite direction to the fluid expelled through the said fluid outlet port.

9. A fluid pump according to claim 1, wherein the housing has an additional fluid outlet port over the region at which the drive engages tangentially with the second pulley wheel with their respective teeth in partial engagement.

10. A fluid pump according to claim 9, wherein the housing has a still further fluid outlet port transversely opposite said additional fluid outlet port so that it receives fluid expelled transversely in the opposite direction.

11. A fluid pump according to claim 1, wherein the fluid outlet port is as wide as between 1 and 4 times the spacing of the teeth of the first pulley wheel.

12. A fluid pump according to claim 11, wherein said width of the outlet port corresponds to the width of between two and four teeth of the first pulley wheel.

* * * * *